US008727302B2

(12) United States Patent
Braun et al.

(10) Patent No.: US 8,727,302 B2
(45) Date of Patent: May 20, 2014

(54) ANCHOR SYSTEM OF A CONCRETE WALL FORMWORK

(75) Inventors: Hans Braun, Memmingen (DE); Bernd Renz, Voehringen (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 13/577,914

(22) PCT Filed: Feb. 1, 2011

(86) PCT No.: PCT/EP2011/051419

§ 371 (c)(1),
(2), (4) Date: Aug. 9, 2012

(87) PCT Pub. No.: WO2011/101240

PCT Pub. Date: Aug. 25, 2011

(65) Prior Publication Data

US 2012/0304570 A1 Dec. 6, 2012

(30) Foreign Application Priority Data

Feb. 18, 2010 (DE) ..... 10 2010 002 108

(51) Int. Cl.
*E04G 17/065* (2006.01)

(52) U.S. Cl.
CPC ..... *E04G 17/0652* (2013.01)
USPC ..... 249/190; 249/40

(58) Field of Classification Search
USPC ..... 249/40, 42, 43, 190, 213, 216
See application file for complete search history.

(56) References Cited

U.S. PATENT DOCUMENTS

| | | | | |
|---|---|---|---|---|
| 3,618,887 | A * | 11/1971 | Eriksson | 249/10 |
| 3,643,909 | A * | 2/1972 | Brosseau | 249/41 |
| 3,822,860 | A * | 7/1974 | Lovisa et al. | 249/217 |
| 5,332,189 | A | 7/1994 | Tseng | |
| 2004/0079860 | A1 * | 4/2004 | Ward et al. | 249/33 |

FOREIGN PATENT DOCUMENTS

| | | |
|---|---|---|
| DE | 16 84 261 | 3/1971 |
| DE | 34 05 976 | 8/1985 |
| DE | 197 54 366 | 6/1999 |
| DE | 103 36 414 | 3/2005 |
| DE | 10 2007 004 226 | 9/2008 |
| EP | 1 541 781 | 6/2005 |

* cited by examiner

*Primary Examiner* — Michael Safavi
(74) *Attorney, Agent, or Firm* — Paul Vincent

(57) ABSTRACT

A locking device 21 for an anchor bar 2 of an anchor system of a concrete wall formwork has an annular sealing element 15 for sealing off an anchor penetration hole 13 in the formwork facing 7 and a threaded nut element 24 for threading the anchor bar 2 into a threaded nut thread of the threaded nut element. A tubular guiding device 45 is flush with the threaded nut thread of the threaded nut element 24 on the end of the threaded nut element 24 to be located at the concrete formwork side. The sealing element 15 has an elastic rubber inner sealing ring 46 and the free end 51 of the guiding device 45 to be located at the formwork element side is sealingly inserted with the inner sealing ring 46 into the sealing element 15.

16 Claims, 4 Drawing Sheets

ANCHOR SYSTEM OF A CONCRETE WALL FORMWORK

This application is the national stage of PCT/EP2011/051419 filed on Feb. 1, 2011 and also claims Paris Convention priority of DE 10 2010 002 108.3 filed on Feb. 18, 2010.

BACKGROUND OF THE INVENTION

The invention relates to an anchor system of a concrete wall formwork with at least one locking device for an anchor bar of the anchor system, wherein the locking device has a threaded nut element for threading the anchor bar through a threaded nut thread of the threaded nut element.

Such anchor systems are used in formwork for steel-reinforced concrete structures. Concrete formwork elements, or formwork elements for short, of concrete wall formworks are made up of a formwork facing and supporting elements, for example, longitudinal girders and tie beams. The two sides of a wall are each formed from one concrete formwork element, that is, a half-formwork, which are held together by anchor bars. The anchor bars are inserted through holes in the formwork facing and fixed at their ends to the elements supporting the formwork facing in such a way that the tensile force exerted on the anchor bars during concrete casting is contained. Normally, the two ends of the anchor bars have threads onto which threaded nuts are threaded as anchor fastenings. This determines the effective length of the anchor bar and therefore the thickness of the concrete wall. At the same time, the pressure exerted during concrete casting by the liquid concrete on the formwork facing is redirected via the threaded nuts onto the anchor bars. The anchor bars are subject to tensile stress during this operation. Between the formwork facings, spacer elements are included in the volume of the concrete wall to be cast that can absorb the compressive forces that occur during concrete casting and mounting of the anchor bars, it being ensured that these compressive forces do not influence the wall thickness in an unwanted way, that is, reduce it.

With the known anchor systems, there are problems with inserting the anchor bar when the concrete wall formwork is erected, if the anchor insertion holes of the formwork elements with their formwork facings facing each other and forming the concrete wall are not sufficiently well-aligned opposite each other.

Because the anchor bar is always inserted from the outside, as seen from the rear of a first formwork element, through the already erected formwork elements, the formwork erector who is positioning the anchor bar cannot see the anchor insertion hole of the second formwork element. The latter anchor insertion hole is found relatively easily but, with poorly aligned anchor insertion holes, the anchor bar extends obliquely with respect to the formwork facing of the formwork elements, making it very difficult to locate the thread of a locking device on the rear of the second formwork element. Moreover, if the anchor bar is oblique in this way, the locking devices cannot lie flat against the formwork elements around their entire circumference, which results in the forces that occur during concrete casting being transmitted to the locking devices concentrated at one point only, which places a heavy load on the locking devices.

A solution to this problem is proposed in DE 10 2007 004 226 A1. Here, too, a concrete wall formwork with a first and a second formwork element, each having a formwork facing, and with an anchor system with an anchor bar and locking devices is disclosed, wherein the formwork elements are disposed opposite each other with the front faces of their formwork facings. Each anchor bar is inserted through a separate anchor penetration hole in the formwork elements. Furthermore, annular sealing elements are provided for sealing the anchor penetration hole in the formwork facings. Each of the locking devices for the anchor bar of the anchor system of the concrete wall formwork has a threaded nut element for threading the anchor bar through a threaded nut thread of the threaded nut element, and a cap plate. The cap plate is fastened to a rear face of one of the formwork elements of the concrete wall formwork. The cap plate has a spherically designed plate region having an opening in which the threaded nut element is disposed having radial clearance, wherein the threaded nut element comprises a groove-like radial circumferential receptacle in which the edges of the opening in the spherical plate region are received. One threaded nut element of each anchor system that is disposed on the side of anchor bar tip, has a tubular guiding device flush with the threaded nut thread of the threaded nut element provided on the end located at the concrete formwork side, which is used to more easily locate the thread opening of the threaded nut head when threading in the anchor bar. Here, however, the problem arises that due to the oblique position of the anchor bar, excessive strain is exerted on the sealing element so that during concrete casting, liquid concrete can escape through the unsealed sections of the anchor penetration holes.

The object of the invention is to provide a locking device for an anchor system and a concrete wall formwork that avoids the disadvantages of prior art, wherein sealing of the anchor penetration holes, through which obliquely positioned anchor bars are inserted, is improved.

This object is solved by the devices of the independent claims. The dependent claims are preferred embodiments of the invention.

SUMMARY OF THE INVENTION

An inventive locking device is suitable for fastening an anchor bar of an anchor system of a concrete wall formwork to a formwork element having a formwork facing. The locking device has an annular sealing element for sealing an anchor penetration hole in the formwork facing, a threaded nut element to thread the anchor bar into a threaded nut thread of the threaded nut element, and a cap plate. The cap plate can be fastened to a rear face of the formwork elements of the concrete wall formwork and has a spherically designed plate region having an opening in which the threaded nut element is disposed having radial clearance. Therein, the threaded nut element has a groove-like radially circumferential receptacle, which accommodates the edges of the opening in the spherical plate region. A tubular guidance device flush with the threaded nut thread of the threaded nut element is provided at the end of the threaded nut element to be located at the concrete formwork side. According to the invention, the sealing element has an inner sealing ring exhibiting rubber elasticity or viscoelasticity and the free end of the guiding device to be located at the formwork element side protrudes sealingly into the inner sealing ring.

When an inventive locking device is used, essentially no liquid concrete can escape through the anchor penetration hole between the anchor bar and the sealing element. Furthermore, the likelihood of damage to the sealing ring when inserting the anchor bar into the guiding device is reduced. Additionally, the asymmetrical pressure load exerted on the rubber-elastic inner sealing ring if the anchor penetration holes are not entirely aligned is reduced, because a distribution of the load exerted by the forces generated by pressure load is made possible because the guiding device makes sealing contact with the inner sealing ring. The anchor bar itself does not fit closely against the inner sealing ring.

Advantages are optimally provided when the free end of the guiding device to be located at the formwork element side is terminated by an outside edge of the inner sealing ring to be disposed on the formwork facing side or protrudes beyond the outside edge on the formwork facing side. This also permits use of a particularly thin inner sealing ring, that is, of an inner sealing ring of low material thickness, giving the sealing ring a high overall degree of elasticity.

The sealing element especially preferably has a metal sleeve, wherein the inner sealing ring is sealingly disposed in the metal sleeve. The metal sleeve prevents damage to the inner sealing ring and protects the inner sealing ring in anchor penetration holes.

The metal sleeve very advantageously has a radial circumferential widening on the formwork facing side extending toward the outside, wherein an end stop for the defined positioning of the sealing element is constituted in an anchor penetration hole.

The sealing element can have an outer ring preferably made of rigid plastic, wherein the outer ring is plugged or threaded onto the metal sleeve. This also permits sealing of the rear face of the formwork facing into the anchor penetration hole of which the sealing element is inserted. Moreover, the outer sealing ring can also be used for thread tightening on the rear.

The free end of the guiding device located at the formwork element side can especially preferably rest against a radial circumferential and widened sealing lip of the inner sealing ring. In this case, the free end of the guiding device can serve as an end stop for an anchor bar to be threaded in.

Particularly large deflections of the threaded nut element are made possible when the spherically designed plate region forms a spherical cup region with a sphere point on the formwork element side, wherein surface regions of the circumferential receptacle of the threaded nut element, which rest on the spherically designed plate region, are constituted such that they are complementarily shaped with respect to the spherically designed plate region.

An anti-rotation lock is preferably provided on the threaded nut element. This anti-rotation lock can, for example, be achieved by constituting the surfaces of the threaded nut element lying one upon the other and the cap plate with great anti-rotation friction, for example, by means of a studded surface. If such a locking device is used, the anchor bar, which, for example, can be threaded from the rear of the first formwork element into the locking device, which is fastened on the rear of the second formwork element, can be threaded in without a formwork erector on the rear of the second formwork element having to operate the locking device during threading to prevent the threaded nut element from rotating with the anchor bar. Such a locking device is therefore suitable, for example, for use in inaccessible regions of the concrete formwork. The anti-rotation lock preferably has a stop element, wherein the stop element prevents rotation of the threaded nut element by stopping on a stop preferably constituted by the fastening elements. This ensures especially simple and reliable securement against rotation. If the stop element is constituted as a wing, a stop located further away from the threaded nut element can also prevent rotation. A stop element is described, for example, in DE 10 2007 004 226 B3.

A further inventive embodiment of the locking devices for fastening to the formwork element to be erected first could be to attach the locking device permanently to the formwork elements. This would have the advantage of obviating preassembly on the formwork element to be erected first.

An inventive concrete wall formwork has a first and a second formwork element each of which have a formwork element with a formwork facing and an anchor system with an anchor bar and an inventive locking device, wherein the formwork elements are disposed opposite each other with the front faces of their formwork facings. The locking device is disposed on the rear face in the region of an anchor penetration hole in the formwork facing of the second formwork element, preferably using fastening means, and the sealing element of the locking device is used to seal the anchor penetration hole in the formwork facing of the second formwork element. In this way, the anchor bar is inserted from the rear face of the formwork facing of the first formwork element through an anchor penetration hole in the formwork facing of the first formwork element and through the sealing element and can be or is threaded into the threaded nut thread of the threaded nut element of the inventive locking device. Here, the free end of the guiding device is constituted on the formwork element side and sealingly inserted with the inner sealing ring into the sealing element so that the free end of the guiding device is positioned in a way defined by the sealing element on the formwork facing.

The anchor bar preferably has a rounded anchor bar tip, which makes it easier to find the thread opening on the free end of the guiding device. The anchor bar advantageously has a first thread in the end region of the anchor bar facing away from the anchor bar tip and a second thread in the end region of the anchor bar near to the anchor bar tip. In the intermediate region, the anchor bar advantageously has a smooth surface, which makes it more difficult for the concrete to become attached.

The anchor rod very advantageously conically tapers between the first and the second thread, which facilitates removal of the anchor bar after a cast concrete wall has set. The thread shape of the first thread can differ from the thread shape of the second thread so that the thread near to the anchor point can be constituted very coarsely, which makes it easier to locate the threaded nut thread of the threaded nut element. The inventive anchor bar has a stop in the region of the point, which, when threaded into the guiding device, fits closely in the free end of the guiding device. Prescribed wall thicknesses are easier to set and imprecise thicknesses of the wall that is to be cast in concrete are avoided.

The free end of the guiding device of the locking device located at the formwork element side is very advantageously aligned with the outside edge of the inner sealing ring located at the formwork element side or projects beyond the outside edge on the formwork element side. In this case, the outside edge of the inner sealing ring of the sealing element located at the formwork element side is essentially aligned with the front side of the formwork facing of the second formwork element. In this way, the edges of the anchor penetration hole are protected and any asymmetrical forces that are exerted on the inner sealing ring are optimally distributed across the width of the inner sealing ring. Here, only the guiding device fits closely in the inner sealing ring.

A further sealing element is especially preferably provided that is identical to the sealing element of the locking device, in particular, a sealing element with an identical inner diameter for sealing the anchor penetration hole in the formwork facing of the first formwork element. In this case, the anchor bar is inserted through the further sealing element. The shape of a conically tapering anchor bar is designed such that the largest diameter of the conical region is adapted to the sealing element to such that it can be inserted into the further sealing element to constitute a seal.

The inventive embodiment of the anchor system has the additional advantage that the same sealing elements can be used on both sides of the formwork elements. This is because the anchor bar on one side and the guiding element on the other side have almost the same outside diameter in the region of the sealing element.

The invention is explained in more detail below based on an embodiment and referring to the drawings.

DESCRIPTION OF THE PREFERRED EMBODIMENT

The figures of the drawings show the inventive object highly schematically and are not scale drawings. The individual parts of the inventive object are shown in such a way that their structure is clearly visible.

Figure 1:
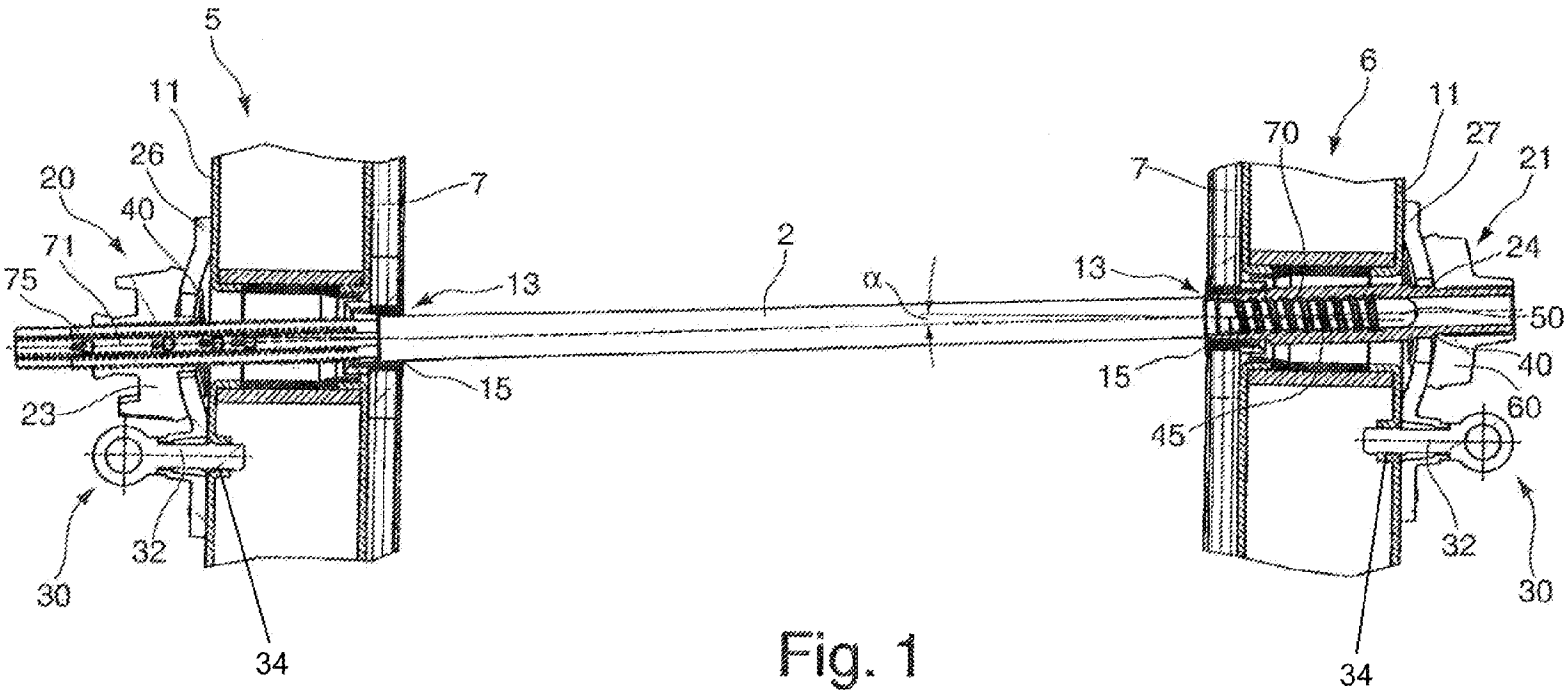
FIG. 1 shows an inventive concrete wall formwork in cross-section in the region where anchor holes are disposed opposite each other and not aligned.
Figure 2A:
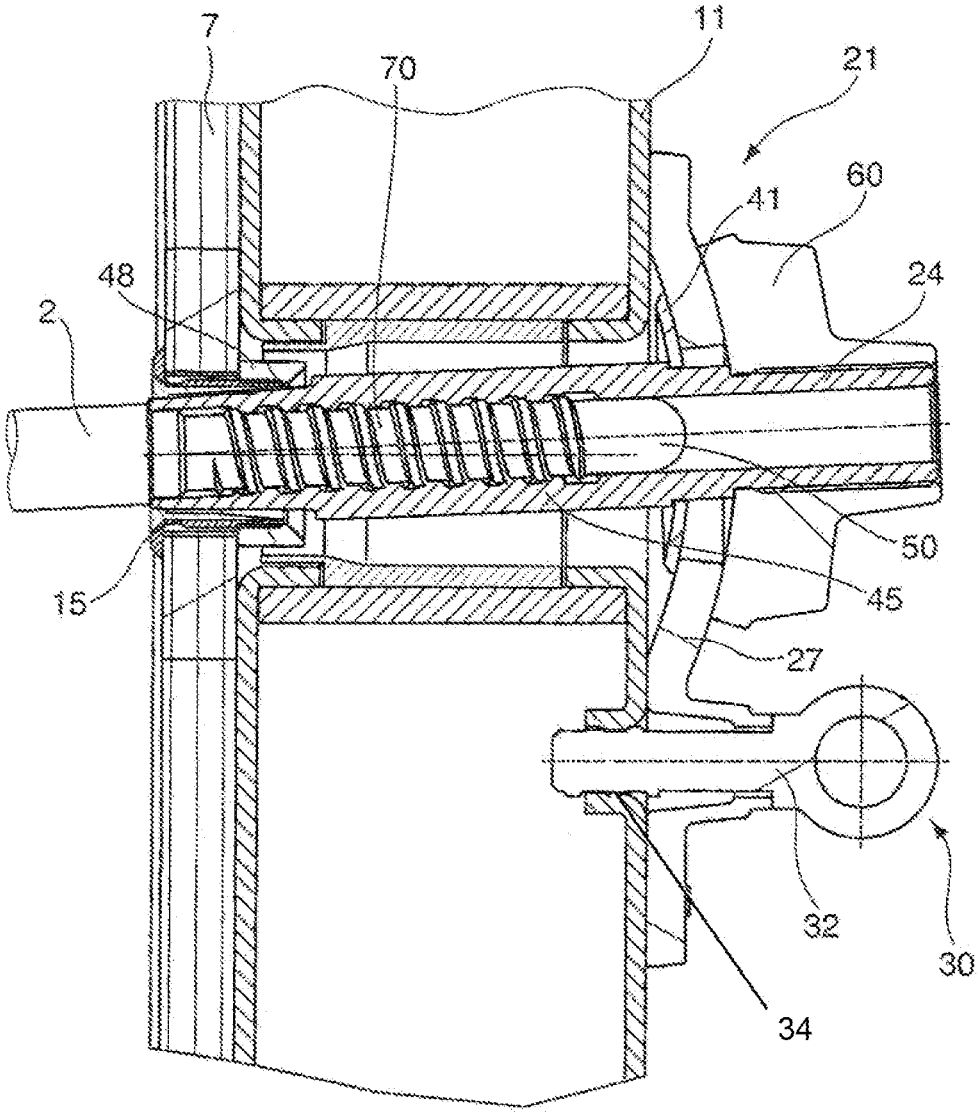
FIGS. 2*a* and 2*b* each show enlarged portions of the concrete wall formwork of FIG. 1, fixed in a position on the rear side of a concrete formwork element.
Figure 2B:
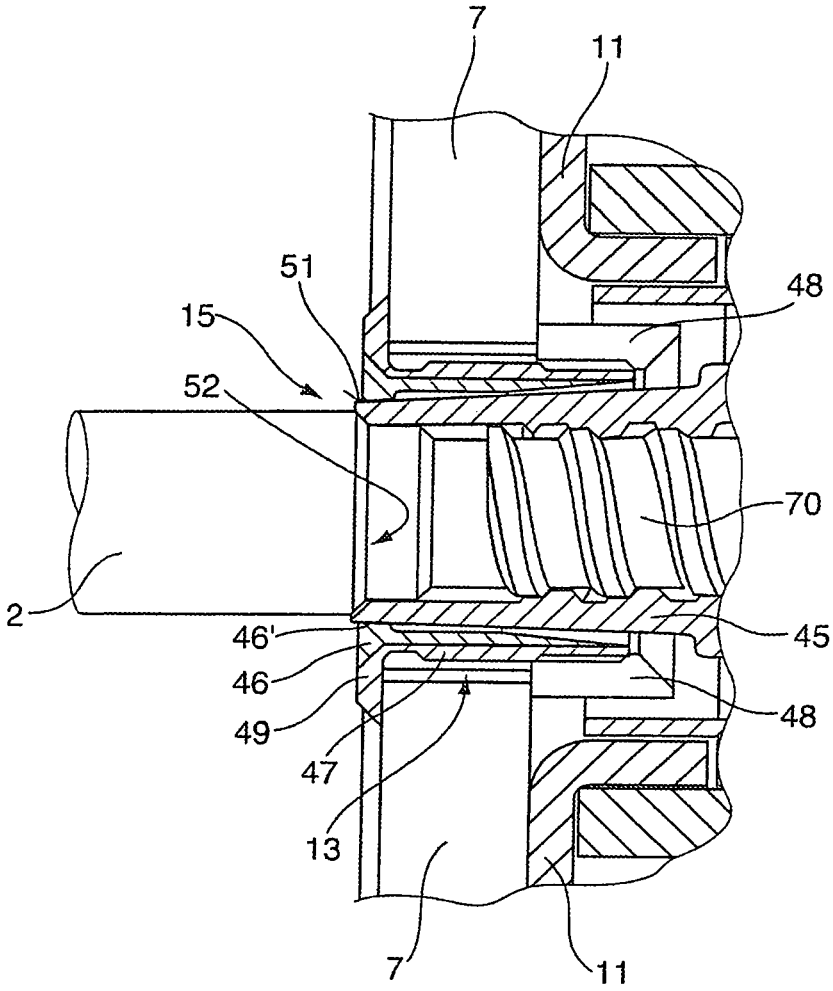
Figure 3:
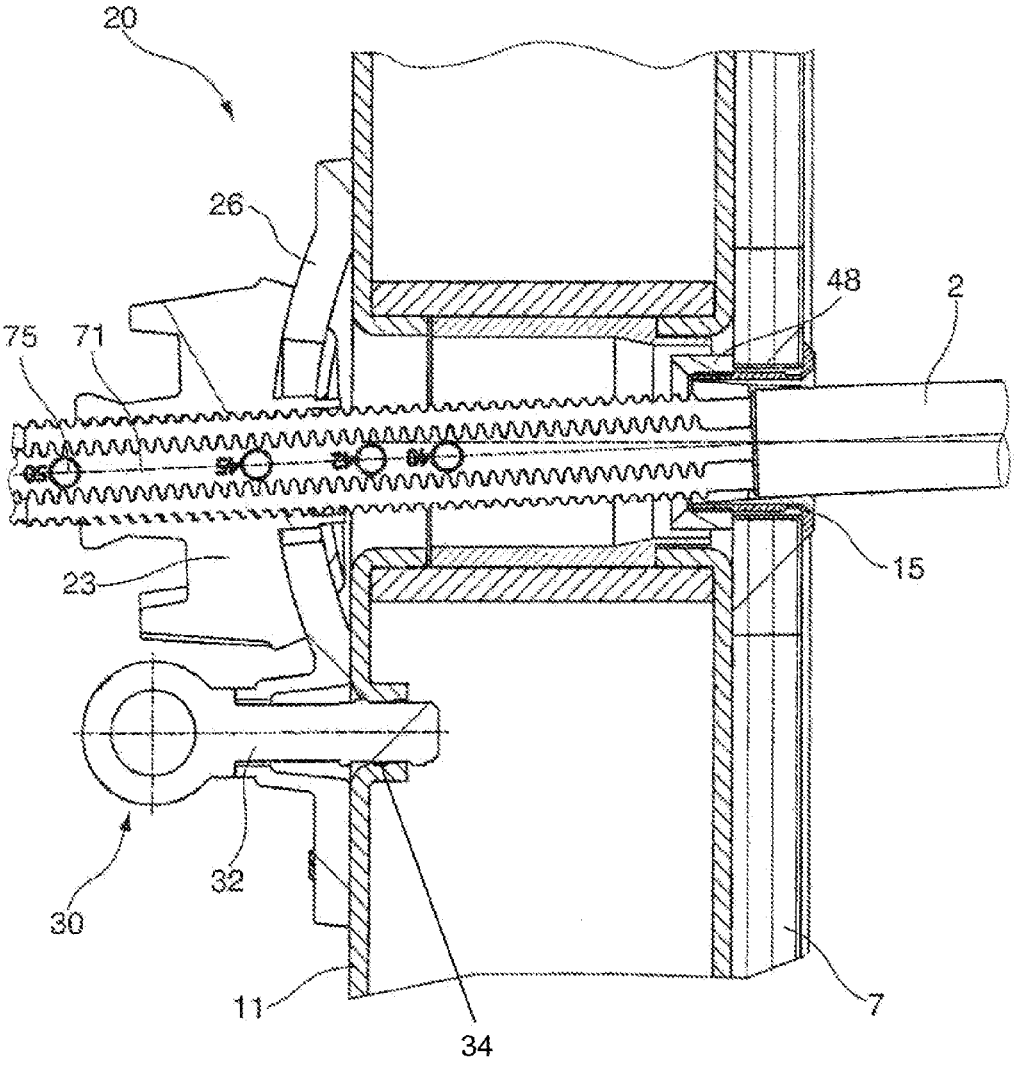
FIG. 3 shows an enlarged detail of the locking device shown on the left in FIG. 1.

FIGS. 2*a*, 2*b* and 3 each show detail views of the inventive concrete wall formwork shown in FIG. 1, wherein each figure shows a cross-section at the level of the longitudinal axis of an anchor bar of the inventive anchor system, which connects a first and a second formwork element 5,6 of the concrete wall formwork. The formwork elements 5,6 each have a formwork facing 7 and longitudinal beams. Any tie beams that may exist are not shown due to the detail selected. The formwork facing 7 is usually mounted on longitudinal beams and tie beams, in particular, riveted on. The anchor bar 2 is aligned obliquely at an angle $\alpha$ with respect to the surfaces of the formwork facings 7.

In each case, the sectional representation in FIG. 1 extends through a longitudinal beam so that each longitudinal beam is only represented by the wall 11 of the steel section from which the beam is made. The front sides of the formwork facings 7 of the formwork elements 5,6 are disposed opposite each other to form a wall to be cast in concrete. One anchor penetration hole 13 is provided in the region of each longitudinal beam in the formwork facings 7. The anchor bar 2 is inserted from the rear of the first formwork element 5 through the anchor penetration holes 13 and the longitudinal beam, in whose region the anchor penetration holes 13 are disposed. Annular sealing elements 15 are disposed and/or inserted in the anchor penetration holes 13 that extend around the anchor bar 2 in such a way that during concrete casting essentially no liquid concrete can exit through the anchor penetration holes 13. On the rear of each of the formwork elements 5,6, one locking device 20,21 is positioned in the anchor penetration holes 13. The locking devices 20,21 each have a threaded nut element 23,24 with a threaded nut thread, that is, a hole with an internal thread, through which the anchor bar 2 is threaded. The locking devices 20,21 also each have a cap plate 26,27 with fastening elements 30 for fastening the cap plate 26,27 and therefore the locking device 20,21 on the rear of each one of the formwork elements 5,6. The fastening elements 30 are constituted by a hole in the edge region of the cap plate 26,27, through which a threaded bolt 32 can be or is threaded into a threaded hole 34 on each longitudinal beam. Clamps, bayonet connectors, and similar fixtures are also conceivable as technically equivalent fastening elements 30. The cap plate 26,27 is made of a steel plate. It has a spherically designed plate region, that is, a plate region shaped as a spherical cup, in which an opening is provided. Each spherical cup has a sphere center located on the side of the formwork element. That is, the curvature of the spherical cup region is chosen in such a way that the center of curvature is located in the region of the formwork element 5,6 to which the associated locking device 20,21 is fastened. This center is preferably located in the formwork facing plane.

The concave surface of the cap plate 26,27 is disposed toward the formwork facing 7 of each formwork element 5,6 and has radial clearance around its entire circumference. The threaded nut element 23,24 of each locking device 20,21 is positioned in the opening. A radial groove is structured around the entire circumference of each threaded nut element 23,24 that constitutes a holder 40 in which the edges of the opening in the spherical plate of the associated cap plate 26,27 are held. The holder 40 has a shape corresponding to the curvature of the spherical plate so that, in view of the radial clearance, deflection of the threaded nut element 23,24 is possible around the entire circumference of the cap plate 26,27, and is guided by the cap plate 26,27. The groove can, for example, have a wall formed by plugging or threading a ring 41 (FIG. 2*a*), on the concrete formwork side, onto a tubular region of a part of the threaded nut element 23,24 structured as a domed cap nut.

A tubular guidance device 45 flush with the threaded nut thread of threaded nut element 24 is provided on the inventive locking device 21 positioned on the second formwork element 6, at the end of the threaded nut element 24 located at the concrete formwork side. This is, for example, a sleeve-like extension, which is constituted on the threaded nut element 24. The thread of the threaded nut element 24 can extend fully or partially inside the extension. In this case, the threaded nut element 24 is constituted as two pieces. It is comprised of the sleeve-like extension, which is constituted integrally together with the guiding device 45 and in which the threaded nut thread is located, and an anti-rotation lock 60 that is threaded or plugged thereon and secured with a splint. The anti-rotation 60 has wing elements that stand radially away from the threaded nut element, so that even a stop that is located further away from the threaded nut element 24 can prevent the threaded nut element 24 from turning with the anchor bar 2 when the latter is threaded in.

As can be seen clearly, in particular, in the detail of FIG. 2*b*, the sealing elements 15 have a rubber-elastic inner sealing ring 46 with a widened sealing lip 46' and a metal sleeve 47, wherein the inner sealing ring 46 is sealingly disposed in the metal sleeve 47. The free end of the guiding device 45 located at the formwork element side is sealingly inserted with the inner sealing ring 46 into the sealing element 15, which is disposed in the anchor penetration hole 13 of formwork facing 7 to which the inventive locking device 21 is fastened. The metal sleeve 47 is provided with a widened section 49, which is disposed radially on the formwork facing side and extends outward and which as a positioning aid defines the slot-in depth of the sealing elements 15 into the anchor penetration holes 13 and forms edge protection. The guiding device 45 is inserted so far into the associated sealing element 15 that it extends slightly beyond the outside surface of the formwork facing 7 and beyond an outside edge of the inner sealing ring 46 that widens in a bulging manner and is disposed on the formwork facing side. The protruding, projecting region is constituted as a free end 51 of the guiding device 45. Likewise, the free end 51 of the guiding device 45 and the widening 49 of the metal sleeve 47 slightly project beyond the outside surface of the formwork facing 7. The sealing elements 15 have an outside ring 48 made of rigid plastic, which is threaded onto the metal sleeve 47 from the rear of the formwork facing 7, wherein, in addition to additional rear sealing of the anchor penetration hole 13, the sealing elements 15 are fixed in position.

The anchor bar 2, which is inserted through the sealing element by means of its tip 50, is inserted directly into the guiding device 45, which is fastened to the anti-rotation lock 60. The anti-rotation lock 60 is constituted as a cap nut. The pivot point (circle center), around which the guiding device 45 and the anti-rotation lock 60 can be swiveled, deflected, or displaced when an anchor bar 2 is inserted, is therefore located in the region of the plane of the formwork facing 7.

Furthermore, one anti-rotation lock 60 is provided on each of the threaded nut elements 24 of the locking devices 21, which are on the rear of the second formwork elements 6, that is, those formwork elements 6, through which the anchor bars 2 are inserted from the front, i.e., from the formwork facing 7. These anti-rotation locks 60 are constituted such that, during rotation of each threaded nut element 24, an outer region of the anti-rotation locks 60 can hit a stop constituted, for example, by the fastening elements 30 of the associated cap plate 27, so that the threaded nut element 24 cannot turn further.

The anchor bar 2 is completely threaded-in in the figures. The threaded nut thread 70 of the anchor bar 2 therefore has, in the region of the tip 50 of the anchor bar 2, a smaller diameter than the remaining anchor bar 2, thus forming a thread stop 52 at the transition of the threaded nut thread 70 to the rest of the anchor bar 2. With this thread stop 52, the fully threaded-in anchor bar 2 abuts against the free end 51 of the guiding device 45. This determines the thread-in depth of the threaded nut thread 70 in the region of the tip 50 of the anchor bar 2 into the threaded nut element 24 of the associated locking device 21. The diameter of the anchor bar 2 in the region of the thread 70 is constant along the length of the thread (cylindrical thread section).

The threaded nut thread of the locking device 20 positioned on the rear of the first formwork element 5, receives an anchor bar with a larger diameter than the threaded nut head of the locking device 21 on the rear of the second formwork element 6. The illustrated anchor bars 2 also have, on their end regions facing away from the tip 50 of each anchor bar, onto which the locking devices 20 fastened on the rear of the first formwork element 5 are threaded, splint holes 75 for inserting locking splints. The wall thickness of the concrete wall to be cast can be defined by positioning these splint holes 75. The anchor bars 2 are shaped conically along their entire length, with the exception of the thread sections 70, 71 constituted on each end.

To permit the anchor system to also absorb the tilting forces exerted on the formwork elements 5,6 during concrete casting, which would cause a reduction in the wall thickness of the concrete wall to be cast, in FIG. 1 a further fastening of the cap plates 26,27 is provided on the rear faces of the formwork elements 5,6. The latter fastening is provided in the figures by means of threaded bolts 32 with molded-on rings. The anchor bar 2 has, in its region to be positioned between the formwork facings 7, a shape that conically tapers toward the relevant anchor tip 50, making the anchor bar 2, in particular, if it has been treated or oiled before application in the concrete wall formwork, easier to remove after the cast concrete wall has set.

The anchor penetration holes 13 of the formwork elements 5,6 of the concrete wall form shown are not disposed opposite each other in such a way that they are aligned. The threaded nut elements 23,24 of the locking devices 20,21 are therefore not disposed centered in the openings of the spherical plate regions of the associated cap plates. The threaded nut elements 23,24 are instead deflected radially over the surfaces of the spherical regions of the cap plates guided by the associated cap plates, so that the anchor bar 2 does not have to be aligned perpendicularly to the formwork facings 7 of the formwork elements 5,6. Obliquely extending anchors can be used permanently and multiply with the inventive locking device and also operated from one side only. The anchor position facing away from the operator side can be securely sealed, wherein the anchor bar itself no longer presses onto the sealing lip of the sealing element. In its final position, the anchor bar is disposed above the thread stop at the free end of the guiding device. The inner sealing ring of the sealing element seals the guiding device.

The invention relates to a locking device 21 for an anchor bar 2 of an anchor system of a concrete wall formwork, having a formwork element 6 comprising a formwork facing 7, having

- an annular sealing element 15 for sealing off an anchor penetration hole 13 in the formwork facing 7,
- a threaded nut element 24 for threading the anchor bar 2 into a threaded nut thread of the threaded nut element 24, and
- a cap plate 27 that can be fastened by means of fastening means 30 to a rear face of the formwork element 6 of the concrete wall formwork and comprises a spherically designed plate region having an opening in which the threaded nut element 24 is disposed having radial clearance, wherein the threaded nut element 24 comprises a groove-like radially circumferential receptacle 40 in which the edges of the opening in the spherical plate region are received, and wherein a tubular guiding device 45 flush with the threaded nut thread of the threaded nut element 24 is provided on the end of the threaded nut element 24 to be located at the concrete formwork side. The sealing element 15 comprises a rubber-elastic inner sealing ring 46 and the free end 51 of the guiding device 45 to be located at the formwork element side is sealingly inserted with the inner sealing ring 46 into the sealing element 15.

The invention is not restricted to the embodiments described above. A number of variations are conceivable that make use of the characteristics of the invention in embodiments implemented in fundamentally different ways.

We claim:

1. A formwork element with a formwork facing and a locking device for an anchor bar of a concrete wall formwork anchor system, the locking device comprising:

- a threaded nut element having a threaded nut thread structured for threading the anchor bar, wherein an end of said threaded nut element which is to be located at the concrete formwork side has an integral tubular guiding device, said tubular guiding device being flush with said threaded nut thread, said guiding device having a free end into which the anchor bar is introduced;
- a cap plate fastened to a rear face of the formwork element of the concrete wall formwork and comprising a spherically designed plate region having an opening in which the threaded nut element is disposed with radial clearance, wherein said threaded nut element has a groove-like radial circumferential receptacle in which edges of the opening in the spherical plate region are received; and an annular sealing element structured for sealing an anchor penetration hole in the formwork facing, said sealing element having an inner sealing ring exhibiting rubber elasticity or viscoelasticity, wherein a free end of said guiding device to be located at a formwork element side sealingly protrudes into said inner sealing ring.

2. The formwork element of claim 1, wherein said free end of said guiding device is flush with an outside edge of the inner sealing ring to be disposed on the formwork facing side or protrudes beyond an outside edge on the formwork facing side.

3. The formwork element of claim 1, wherein said sealing element has a metal sleeve, said inner sealing ring being sealingly disposed in said metal sleeve.

4. The formwork element of claim 3, wherein said metal sleeve has a radial circumferential and radially outwardly projecting widening to be disposed on the formwork facing side.

5. The formwork element of claim 3, wherein said sealing element has an outside ring preferably made of rigid plastic, said outside ring being plugged or threaded onto said metal sleeve.

6. The formwork element of claim 1, wherein said free end of said guiding device to be located at the formwork element side rests against a radial circumferential widened sealing lip of said inner sealing ring.

7. The formwork element of claim 1, wherein said spherically designed plate region constitutes a spherical cup region with a sphere center on the formwork element side, surface regions of said circumferential receptacle of said threaded nut element that rest against said spherically designed plate region being constituted such that they are complementarily shaped with respect to said spherically designed plate region.

8. The formwork element of claim 1, wherein an anti-rotation lock is provided on said threaded nut element.

9. The formwork element of claim 8, wherein said anti-rotation lock has a stop element preferably constituted as a wing, said stop element structured to prevent rotation of said threaded nut element by stopping against a stop or against fastening elements.

10. A concrete wall formwork with a second formwork element having the locking device of claim 1, the concrete wall formwork further comprising:

a first formwork element, each of said first and said second formwork elements having a formwork facing, wherein formwork facings of said first and said second formwork elements are disposed opposite each other; and an anchor system having an anchor bar, said anchor bar structured for insertion from a rear face of said formwork facing of said first formwork element through an anchor penetration hole in said formwork facing of said first formwork element and through said sealing element, said anchor bar also being structured for threading into said threaded nut thread of said threaded nut element of the locking device.

11. The concrete wall formwork of claim 10, wherein said anchor bar has a rounded anchor bar tip, a first thread in an end region of said anchor bar facing away from said anchor bar tip and a second thread in an end region of the anchor bar proximate said anchor bar tip.

12. The concrete wall formwork of claim 11, wherein said anchor bar conically tapers between said first and said second thread toward said anchor bar tip.

13. The concrete wall formwork of claim 11, wherein a thread shape of said first thread differs from the thread shape of said second thread.

14. The concrete wall formwork of claim 11, wherein a thread stop is constituted on said anchor bar at an end of said second thread that faces away from said anchor bar tip, said second thread of said anchor being structured to fully thread, against a stop, into said threaded nut element of said locking device.

15. The concrete wall formwork of claim 10, wherein said free end of said guiding device of the locking device located at the formwork element side is flush with said outside edge of said inner sealing ring located at the formwork element side or projects or protrudes beyond said outside edge on the formwork element side, wherein said outside edge of the inner sealing ring of said sealing element constituted on the formwork element side is essentially flush with said front face of the formwork facing of said second formwork element.

16. The concrete wall formwork of claim 10, wherein a further sealing element identical with said sealing element of the locking device for sealing said anchor penetration hole in said formwork facing of said first formwork element is provided in said anchor penetration hole in said formwork facing of said first formwork element, wherein said anchor bar is inserted through said further sealing element in a settled state of said anchor bar.

* * * * *